US010104457B2

(12) United States Patent
Mobed et al.

(10) Patent No.: US 10,104,457 B2
(45) Date of Patent: Oct. 16, 2018

(54) SPEAKER

(71) Applicant: Bose Corporation, Framingham, MA (US)

(72) Inventors: Darius Darayes Mobed, Watertown, MA (US); Lee Zamir, Cambridge, MA (US); Laszlo Otto Drimusz, Framingham, MA (US)

(73) Assignee: BOSE CORPORATION, Framingham, MA (US)

( * ) Notice: Subject to any disclaimer, the term of this patent is extended or adjusted under 35 U.S.C. 154(b) by 0 days.

(21) Appl. No.: 15/385,246

(22) Filed: Dec. 20, 2016

(65) Prior Publication Data

US 2018/0176671 A1 Jun. 21, 2018

(51) Int. Cl.
*H04R 1/02* (2006.01)
*H04R 1/24* (2006.01)
*H04R 9/06* (2006.01)

(52) U.S. Cl.
CPC ..... *H04R 1/025* (2013.01); *H04R 1/24* (2013.01); *H04R 9/06* (2013.01)

(58) Field of Classification Search
CPC H04R 1/02; H04R 2420/07; H04R 2201/028; H04R 1/025; H04R 1/24; H04R 1/16; H04R 1/18; H04R 1/20; H04R 1/22; H04R 1/227; H04R 1/28; H04R 1/2803–1/2896; H04R 1/42; H04R 1/44; H04R 9/06; H04R 9/063; H04R 9/066; H04R 2460/13; H04R 2440/00; H04R 2400/01; H04R 2440/03; H04R 2440/05; H04R 2440/07; H03F 3/181; F21V 33/0056; F21S 10/06; F21W 2121/00
USPC ..... 381/332, 89, 333, 334, 336, 111, 116, 381/117, 152, 337, 338, 339, 343, 345, 381/346, 347, 348, 349, 350, 353, 354, 381/162, 167, 184, 185, 385, 386, 387, 381/388, 389, 392, 395, 398, 399, 404, 381/411, 423, 427, 428, 429, 430, 431, 381/432, 190, 191, 151; 700/94; 367/162, 163, 165
See application file for complete search history.

(56) References Cited

U.S. PATENT DOCUMENTS

2002/0159610 A1* 10/2002 Bank ..... H04R 1/025 381/152
2015/0086044 A1* 3/2015 Zamir ..... H03F 3/181 381/120
2016/0142822 A1* 5/2016 Bartylla ..... H04R 1/26 381/190

* cited by examiner

*Primary Examiner* — Leshui Zhang
(74) *Attorney, Agent, or Firm* — Patterson + Sheridan, LLP

(57) ABSTRACT

A speaker includes a housing; an electroacoustic driver secured to the housing, and an element that is secured to a movable portion of the driver. The element is accessible from outside of the housing and is capable of having an object secured to the element. When the driver is operated in a first mode in a first frequency band, motion is imparted through the element to the object.

12 Claims, 2 Drawing Sheets

SPEAKER

FIELD OF THE DISCLOSURE

The present disclosure relates to a speaker kit and components thereof.

BACKGROUND

With the increase in prevalence of mobile computing devices, children are being introduced to computing technology at a younger age. For example, it is common for a child to be proficient in operating a mobile phone or a tablet computer. It is desirable to encourage children's interest and familiarity with aspects of audio, video, and communications technologies.

SUMMARY

In one aspect, a speaker includes a housing; an electroacoustic driver secured to the housing, and an element that is secured to a movable portion of the driver. The element is accessible from outside of the housing and is capable of having an object secured to the element. When the driver is operated in a first mode in a first frequency band, motion is imparted through the element to the object.

Embodiments may include one of the following features, or any combination thereof. The element is a platform. The movable portion of the driver includes a diaphragm. The element is secured to the diaphragm. The driver can be operated in a second mode in a second frequency band to perform audio information. A center of the first frequency band is lower than a center of the second frequency band. The speaker further includes a first manually operable control which causes the driver to operate in the second mode when the control is put in a predefined position. The driver is operated in the first mode when the control is moved away from the predefined position. The speaker further includes a second manually operable control which controls (i) a speaker volume when the speaker is operated in the second mode, and (ii) an amplitude of the motion of the element when the speaker is operated in the first mode.

In another aspect, an electroacoustic driver includes an electromagnetic motor, a diaphragm which is movable by the motor, and an element that is secured to the diaphragm. The element is accessible from outside of a housing to which the driver can be secured. The element is capable of having an object secured to the element. When the driver is operated in a first mode in a first frequency band, motion is imparted through the element to the object.

Embodiments may include one of the above and/or below features, or any combination thereof. The housing encompasses an acoustic volume and is ported such that the acoustic volume is vented to an external atmosphere outside of the housing.

In yet another aspect, a speaker kit includes a plurality of housing portions, an electroacoustic driver secured to one of the housing portions, and an additional element attached to a movable portion of the driver. The element and driver are located on substantially opposite sides of the housing portion. The element is capable of having an object secured to the element. The housing portions can be assembled together to form a speaker housing that encompasses an acoustic volume. When the driver is operated in a first mode in a first frequency band, motion is imparted through the element to the object.

Embodiments may include one of the above and/or below features, or any combination thereof. A first housing portion can be removably secured to a second housing portion. One or more of a first housing portion and a second housing portion includes a sealing element such that when the housing portions are secured together, the sealing element provides an acoustic seal where the housing portions are secured together.

All examples and features mentioned above can be combined in any technically possible way. Other features and advantages will be apparent from the description and the claims.

DESCRIPTION

The user-assembled speaker kit described below encourages understanding of a variety of technologies, such as acoustics, communications, video, and electro-mechanical technologies.

Figure 1:
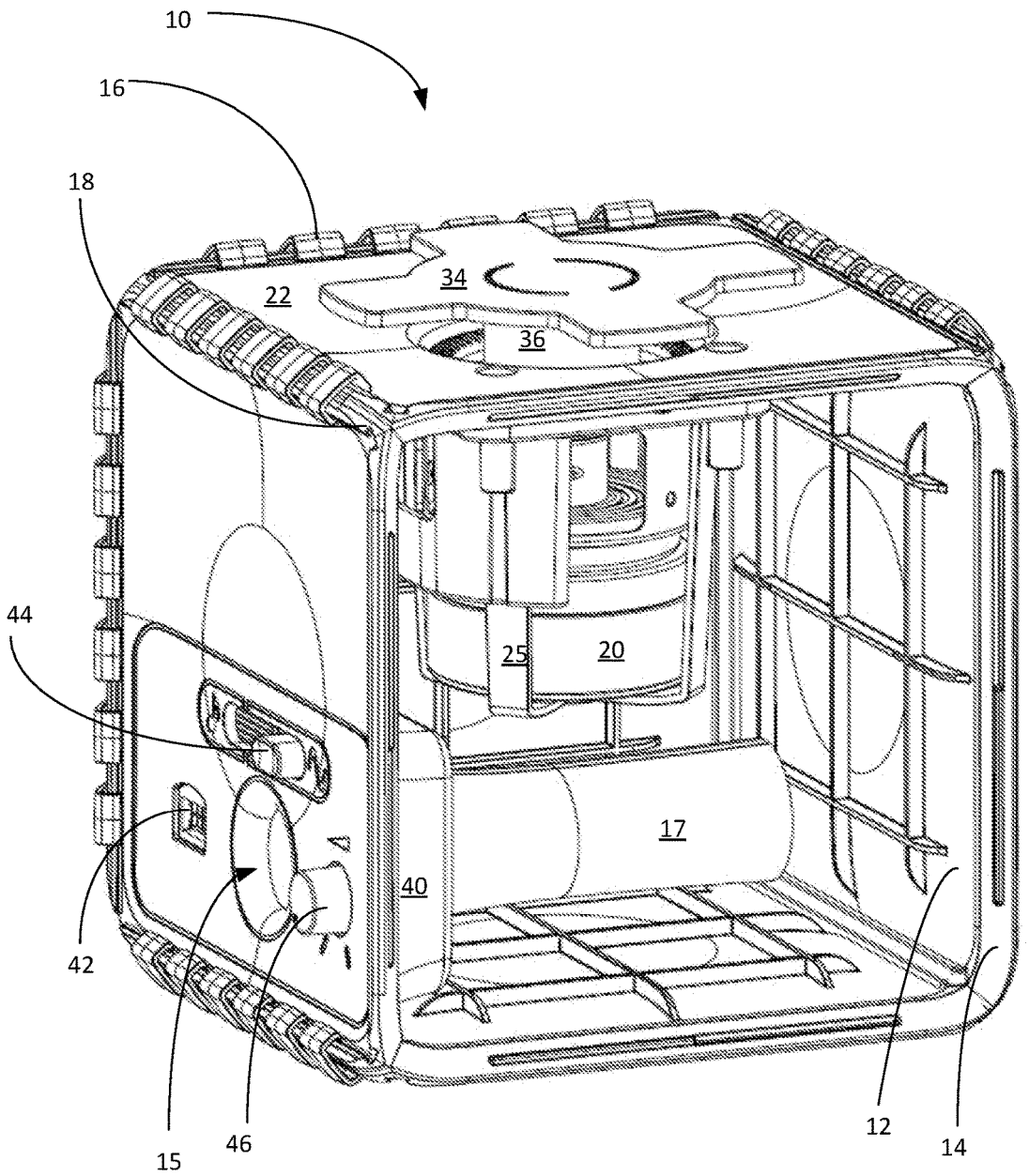
FIG. 1 is a perspective view of a loudspeaker as shown from the front, top and right sides with a housing side removed to facilitate viewing.

Referring to FIG. 1, a loudspeaker or speaker 10 includes a housing 12. In this example the speaker 10 is a bass box that is tuned to between about 50-60 Hz and is substantially in the shape of a cube. The speaker 10 has been assembled from a kit in which the six sides (or portions) of the housing 12 are separate from each other. Each of the housing sides in this example are made of opaque plastic but could alternatively be made of another material such as a translucent or transparent plastic. If a transparent plastic is used, this plastic can be a polycarbonate or a clear acrylonitrile butadiene styrene. A port 15 in a front side of the housing vents an acoustic volume encompassed by the housing 12 to an external atmosphere outside of the housing via a conduit 17. Each housing side has a sealing element 14 (e.g. a thermoplastic elastomer gasket) that is located about a periphery of the housing side.

A series of fastening mechanisms in the form of clips 16 are used to hold the housing sides together such that the housing sides and gaskets 14 form an acoustic seal (a substantially airtight seal that preferably has less than about 1% leakage to/from an external environment) that encompasses an acoustic volume. Each clip 16 is slid onto or snapped onto a pair of adjacent edges of a respective pair of housing sides. The edges of the housing sides each have a lip 18 onto which the clip can grab and remain secured. The clips 16 are preferably made of plastic or metal. A single longer clip can be used on each pair of mating housing sides instead of a plurality of shorter clips. As such, the housing sides can be removably secured to each other allowing the housing to be assembled and disassembled as often as is desired. In another example screws, bolts, nails or other fasteners are used instead of or in addition to clips to hold the housing portions together.

In other examples, instead of providing the speaker 10 in the form of a kit which requires all of the housing sides and possibly other parts to be assembled, the speaker can be provided in a partially or fully assembled arrangement. For instance, the speaker may be provided with all but one of the housing sides permanently secured together such that only one side needs to be removably or permanently secured to the rest of the housing. In another example, the speaker is provided in a fully assembled arrangement with no parts requiring assembly.

Figure 2:
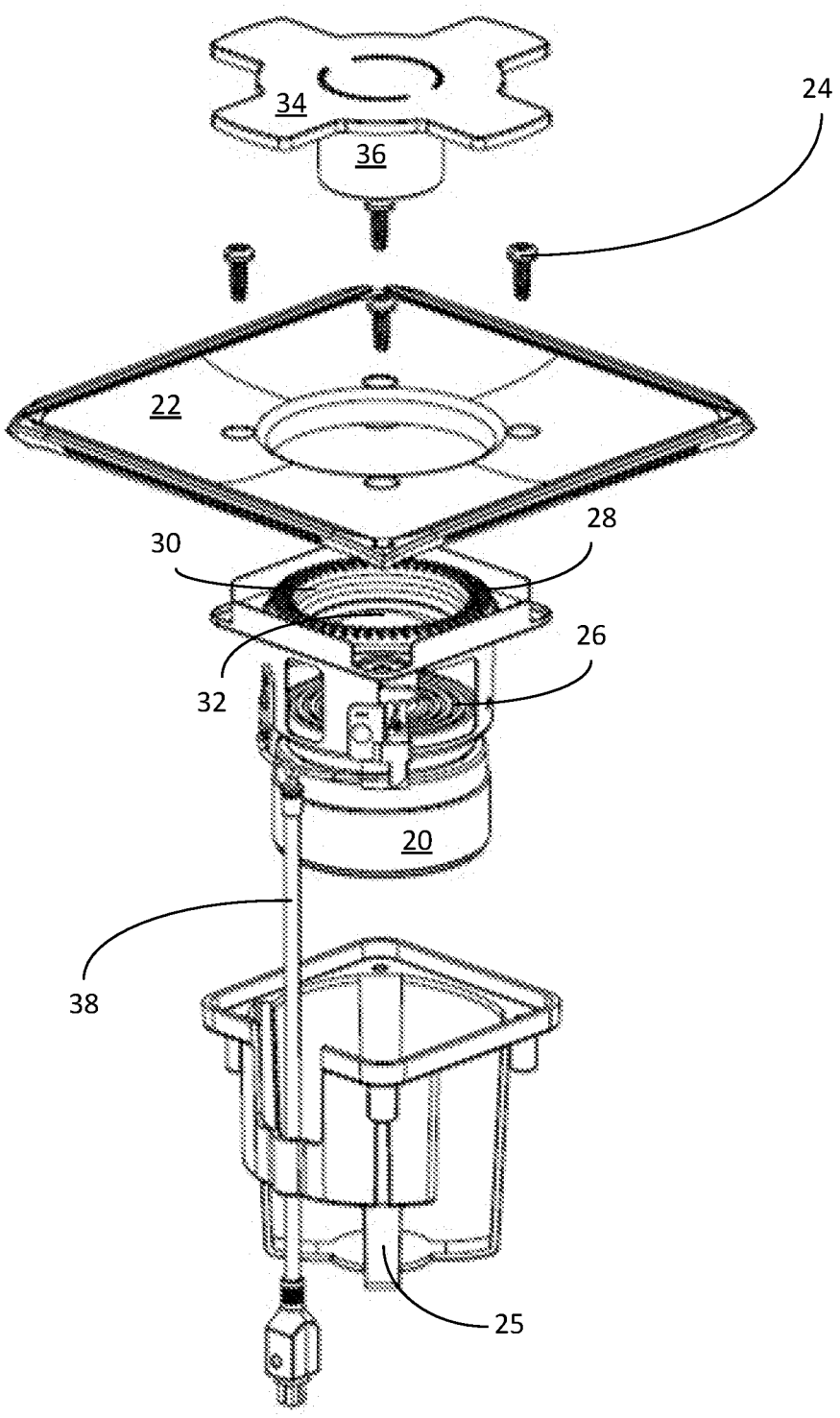
FIG. 2 is an exploded perspective view of a portion of the loudspeaker of FIG. 1.

Referring to FIGS. 1 and 2, an electroacoustic driver 20 is secured to a housing side 22 by four screws 24. An acoustic seal is formed between the driver 20 and the housing side 22. The screws 24 also secure a driver support structure 25 to the driver 20. As such, the driver 20 is suspended from the housing side 22. The driver 20 includes a linear electromagnetic motor (not visible), a spider 26, a surround 28, a diaphragm 30 and a dust cap 32. The motor moves the diaphragm back and forth to create acoustic waves.

A plastic element in the form of a platform 34 is secured to a movable portion of the driver 20. More specifically, a platform support 36 in the shape of a cylinder, which extends from the platform 34, is adhered to an interface of the diaphragm 30 and the dust cap 32 with an adhesive such as a two-part five minute epoxy is one example or a rubber-based contact adhesive. Alternatively, the support 36 can be secured to the diaphragm alone. Note that the platform 34 is accessible from outside of the housing and is located on the opposite side of the housing portion 22 from the driver 20.

An electrical power cable 38 provides an amplified audio signal to the driver 20. An end of the cable 38 opposite of the driver 20 is plugged into a back of a control module 40. A jack 42 on a front of the control module 40 can receive a cable from another speaker which provides an amplified audio signal, electric power, and communications to the control module 40. This other speaker can be a speaker described in U.S. patent application Ser. No. 14/618,963 which was filed on Feb. 10, 2015 and which is incorporated herein by reference. In another example, the jack 42 can be eliminated and the speaker 10 can include its own audio amplifier and receive electrical power from AC mains and/or a battery contained within the housing 12.

The module 40 includes a microcontroller for controlling operation of the speaker 10. A first manually operable control in the form of a slider switch 44 is used to set a mode in which the speaker 10 is operated. When the switch 44 is slid to a predefined position all the way to the left, the speaker is operated in an audio mode in order to perform audio information (e.g. play music) out loud. In audio mode the driver 20 is being operated, for example in a frequency band of about 30 Hz to about 200 Hz. In audio mode a second manually operable control in the form of a knob 46 is rotated to control a volume at which the speaker is performing audio information. The speaker 10 can also include light emitting diodes (e.g. red, green and blue diodes) which can be used to illuminate, for example, the port 15 and/or the interior of the speaker (e.g. when the housing is translucent or transparent).

When the slide switch 44 is moved away from the fully left position, the speaker 10 is placed in a motion mode in which the position of the switch 44 sets the frequency at which the driver 20 and thus platform 34 is moved or vibrated in a sinusoidal manner. For example, when the switch 44 is moved a bit away from the fully left position, the platform is vibrated, for example, at about 10 Hz. As the switch 44 is moved further to the right, the frequency is increased until the switch reaches the fully right position. When the switch 44 is in the fully right position the platform is vibrated, for example, at about 40 Hz. Note that a center of this frequency band (i.e. 25 Hz) is lower than a center of the second frequency band mentioned in the previous paragraph (i.e. 115 Hz). In motion mode the knob 46 is used to set an amplitude of a sine wave that is being applied to the driver 20. The amplitude range of the platform 34 that the knob 46 controls is preferably from about 0 mm (off) to about 10 mm peak-to-peak (+/−5 mm from a center position).

Prior to placing the speaker 10 into motion mode, an object such as a paper character (e.g. a human figure, not shown) is secured to the platform 34 by, for example, tape. When the driver 20 is then operated in motion mode, motion is imparted through the platform 34 to the object. A user of the speaker 10 can observe how the object moves, and how this movement changes as the frequency and/or amplitude of the motion are changed. Alternatively, an object can be placed on the platform 34 without securing the object to the platform. A strobe light can also be used to alter the perceived motion of the object.

A number of implementations have been described. Nevertheless, it will be understood that additional modifications may be made without departing from the scope of the inventive concepts described herein, and, accordingly, other embodiments are within the scope of the following claims.

What is claimed is:

1. A speaker, comprising:

a housing;

an electroacoustic driver secured to the housing;

an element that is secured to a movable portion of the electroacoustic driver, the element being accessible from outside of the housing, the element being capable of having an object secured to the element, whereby when the driver is operated in a first mode in a first frequency band, motion is imparted through the element to the object secured to the element, and whereby when the driver is operated in a second mode in a second frequency band, a music audio is generated via movement of the element, wherein a center frequency of the first frequency band is lower than a center frequency of the second frequency band; and a first manually operable control which causes the electroacoustic driver to operate in the second mode when the control is put in a predefined position, the electroacoustic driver being operated in the first mode when the control is moved away from the predefined position.

2. The speaker of claim 1, wherein the element is a platform.

3. The speaker of claim 1, wherein the movable portion of the driver includes a diaphragm, and wherein the element is secured to the diaphragm.

4. The speaker of claim 1, further including a second manually operable control which controls (i) a speaker volume when the speaker is operated in the second mode, and (ii) an amplitude of the motion of the element when the speaker is operated in the first mode.

5. An electroacoustic driver, comprising:

an electromagnetic motor;

a diaphragm which is movable by the electromagnetic motor;

an element that is secured to the diaphragm, the element being accessible from outside of a housing to which the electroacoustic driver can be secured, the element being capable of having an object secured to the element, whereby when the electroacoustic driver is operated in a first mode in a first frequency band, motion is imparted through the element to the object secured to the element, and whereby when the electroacoustic driver is operated in a second mode in a second frequency band, a music audio is generated via movement of the diaphragm, wherein a center frequency of the first frequency band is lower than a center frequency of the second frequency band; and a manually operable control which causes the electroacoustic driver to operate in the second mode when the control is put in a predefined position, the electroacoustic driver being operated in the first mode when the control is moved away from the predefined position.

6. The electroacoustic driver of claim 5, wherein the element is a platform.

7. The electroacoustic driver of claim 5, wherein the housing encompasses an acoustic volume, the housing being ported such that the acoustic volume is vented to an external atmosphere outside of the housing.

8. A speaker kit, comprising:

a plurality of housing portions;

an electroacoustic driver secured to one of the housing portions;

an element attached to a movable portion of the electroacoustic driver, the element and electroacoustic driver being located on substantially opposite sides of the housing portion, the element being capable of having an object secured to the element, whereby the housing portions can be assembled together to form a speaker housing that encompasses an acoustic volume, and whereby when the electroacoustic driver is operated in a first mode in a first frequency band, motion is imparted through the element to the object secured to the element, and whereby when the electroacoustic driver is operated in a second mode in a second frequency band, music audio is generated and motion is imparted to the element, wherein a center frequency of the first frequency band is lower than a center frequency of the second frequency band; and a manually operable control which causes the electroacoustic driver to operate in the second mode when the control is put in a predefined position, the electroacoustic driver being operated in the first mode when the control is moved away from the predefined position.

9. The speaker kit of claim 8, wherein the element is a platform.

10. The speaker kit of claim 8, wherein the movable portion of the electroacoustic driver includes a diaphragm, and wherein the element is adhered to the diaphragm.

11. The speaker kit of claim 8, wherein a first housing portion can be removably secured to a second housing portion.

12. The speaker kit of claim 8, wherein one or more of a first housing portion and a second housing portion includes a sealing element such that when the housing portions are secured together, the sealing element provides an acoustic seal where the housing portions are secured together.

* * * * *